United States Patent [19]

Ai et al.

[11] Patent Number: 4,550,766

[45] Date of Patent: Nov. 5, 1985

[54] ROLL CASTER APPARATUS HAVING NOZZLE TIP ASSEMBLY WITH NOVEL SPACER MEMBER

[75] Inventors: Daniel K. Ai, New Kensington; Ho Yu, Murrysville, both of Pa.

[73] Assignee: Aluminum Company of America, Pittsburgh, Pa.

[21] Appl. No.: 597,835

[22] Filed: Apr. 9, 1984

[51] Int. Cl.[4] ..... B22D 11/06; B22D 11/10

[52] U.S. Cl. ..... 164/428; 164/480; 222/591

[58] Field of Search ..... 164/87, 428, 437, 438, 164/439, 440; 222/591, 594, 606, 607

[56] References Cited

U.S. PATENT DOCUMENTS

| | | | |
|---|---|---|---|
| 2,098,937 | 11/1937 | Brinkmann | 222/591 |
| 2,143,336 | 1/1939 | Walton | 22/57.5 |
| 3,746,072 | 7/1973 | Richardson | 164/87 |
| 3,799,410 | 3/1974 | Blossey et al. | 222/566 |
| 3,805,877 | 4/1974 | Ward | 164/278 |
| 4,054,173 | 10/1977 | Hickam | 164/428 |
| 4,153,101 | 5/1979 | Chateau et al. | 164/428 |
| 4,232,804 | 11/1980 | Lewis et al. | 222/591 |

*Primary Examiner*—W. D. Bray

*Attorney, Agent, or Firm*—Andrew Alexander; John P. Taylor

[57] ABSTRACT

An improved roll caster tip apparatus is disclosed comprising a molten metal reservoir having a bottom plate and at least one sidewall and a tip member attached to the sidewall having a top wall, a bottom wall, a pair of side riser members between the top wall and the bottom wall to form a passageway with the top and bottom walls and at least one spacer member between the top wall and the bottom wall spaced from the side riser members to provide support for the top wall and bottom wall, the spacer member having a curved leading portion facing the reservoir and a streamlined trailing portion extending in the direction away from the reservoir whereby interference with metal flow velocity by flow separation caused by the spacer is minimized.

10 Claims, 16 Drawing Figures

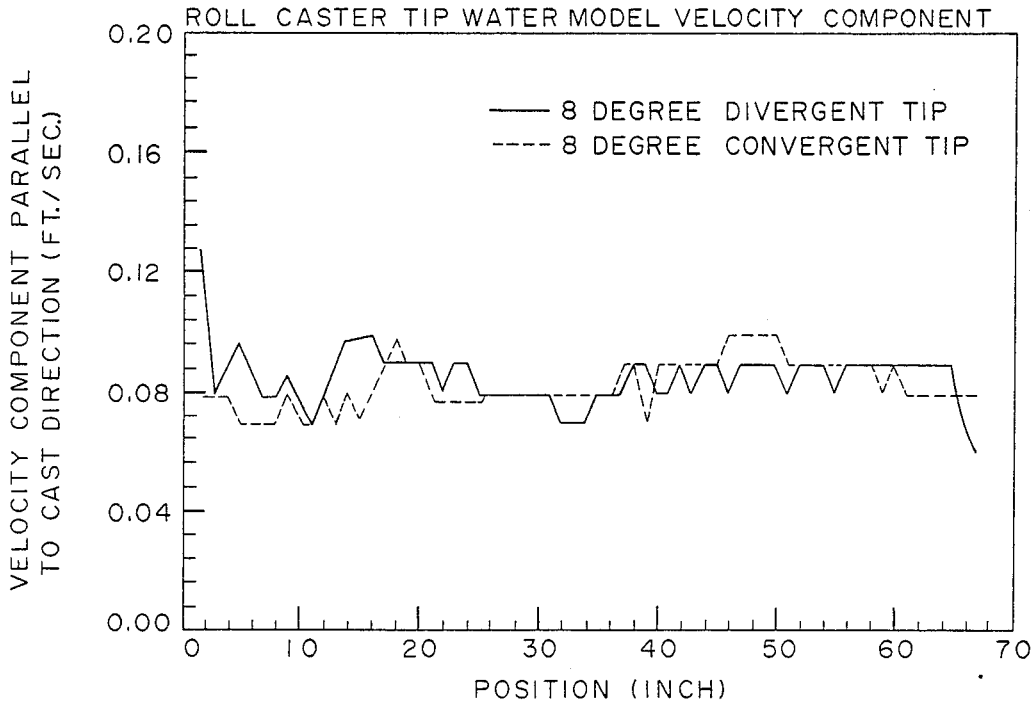
FIGURE 9 EQUIVALENT CASTING RATE 80 LBS./HR./INCH
READINGS 7.5 INCHES FROM TIP DISCHARGE
CASTING DIRECTION IS POSITION
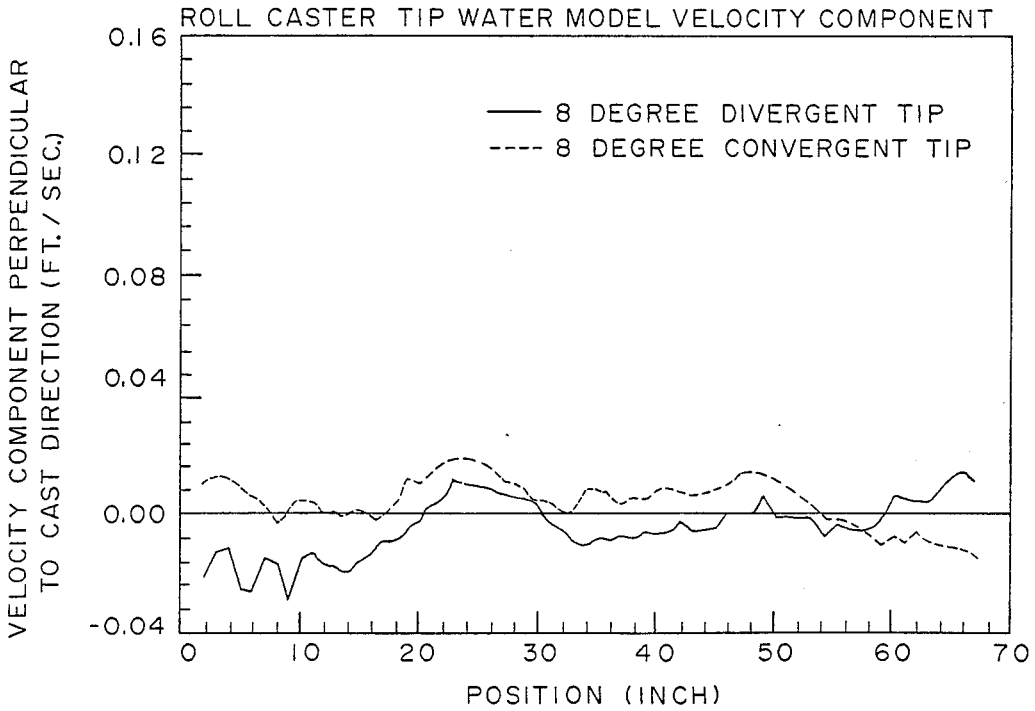
FIGURE 10 EQUIVALENT CASTING RATE 80 LBS./HR./INCH
READINGS 7.5 INCHES FROM TIP DISCHARGE
90 DEG. COUNTER CLOCKWISE TO CASTING DIRECTION IS POSITIVE

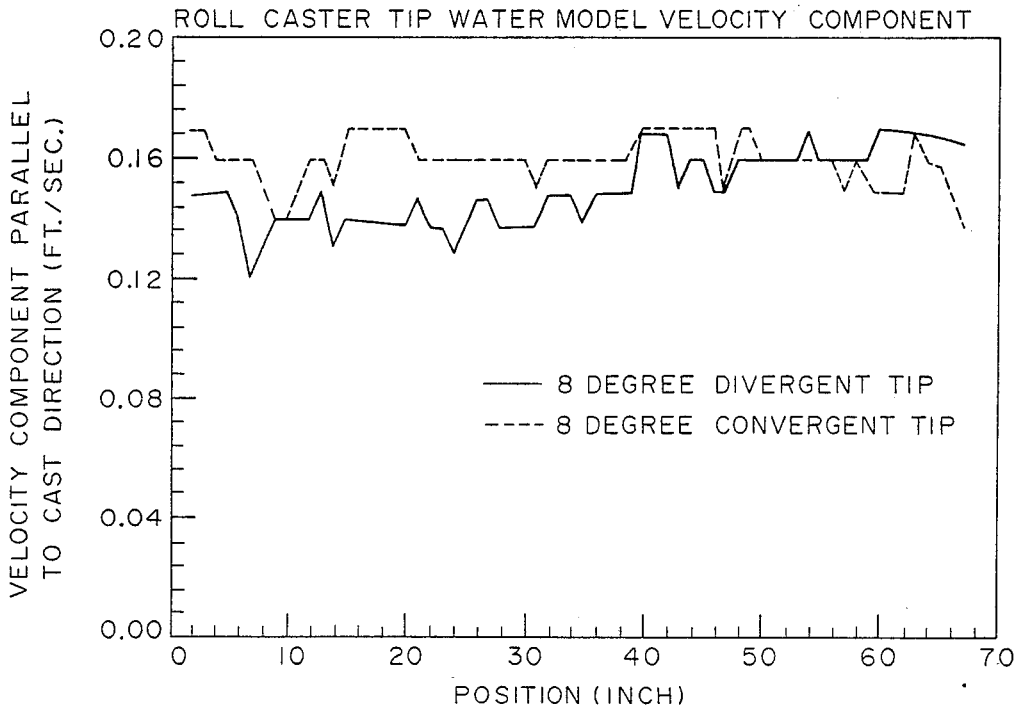
FIGURE 11 EQUIVALENT CASTING RATE 80 LBS./HR./INCH
READINGS 2.5 INCHES FROM TIP DISCHARGE
CASTING DIRECTION IS POSITIVE
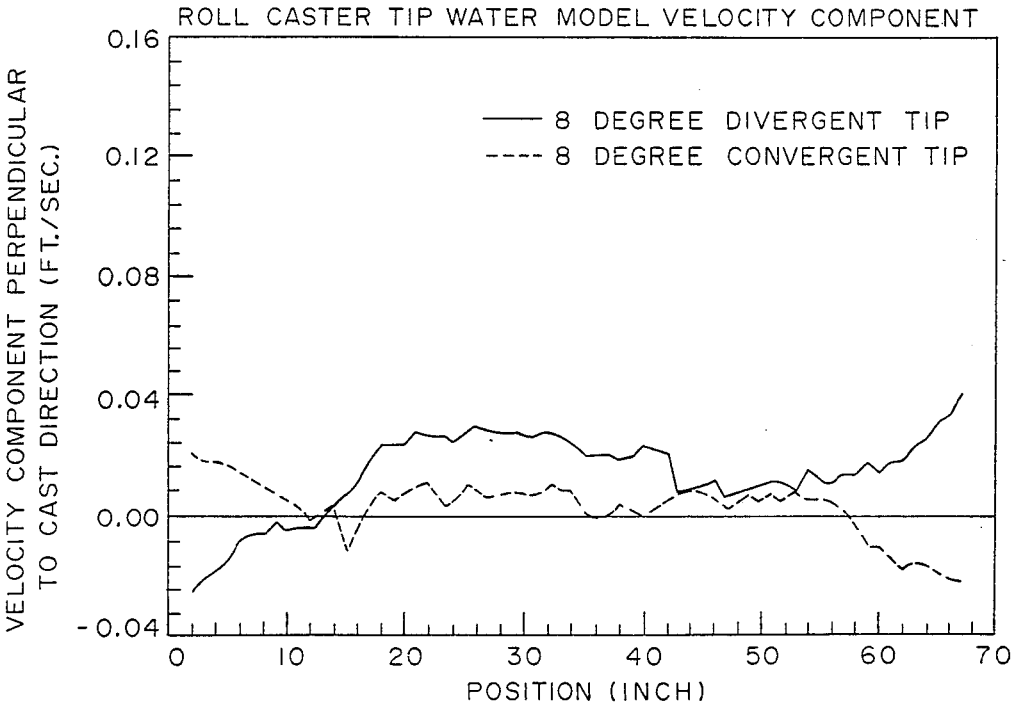
FIGURE 12 EQUIVALENT CASTING RATE 80 LBS./HR./INCH
READINGS 2.5 INCHES FROM TIP DISCHARGE
90 DEG. COUNTER CLOCKWISE TO CASTING DIRECTION IS POSITIVE

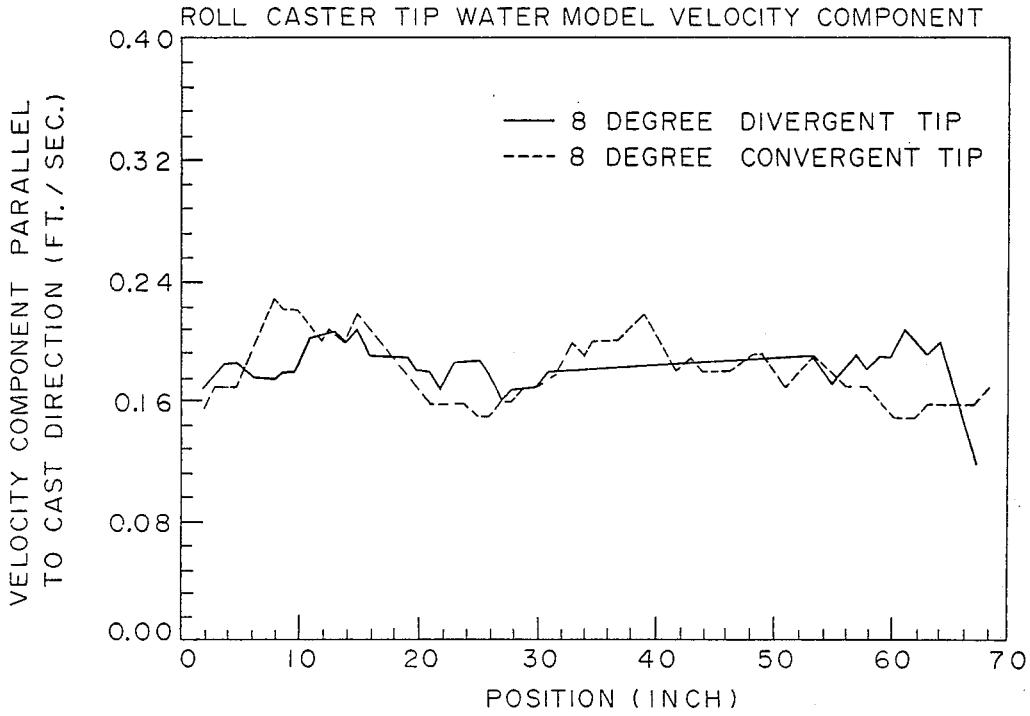
FIGURE 13 EQUIVALENT CASTING RATE 180 LBS./HR./INCH
READINGS 7.5 INCHES FROM TIP DISCHARGE
CASTING DIRECTION IS POSITIVE
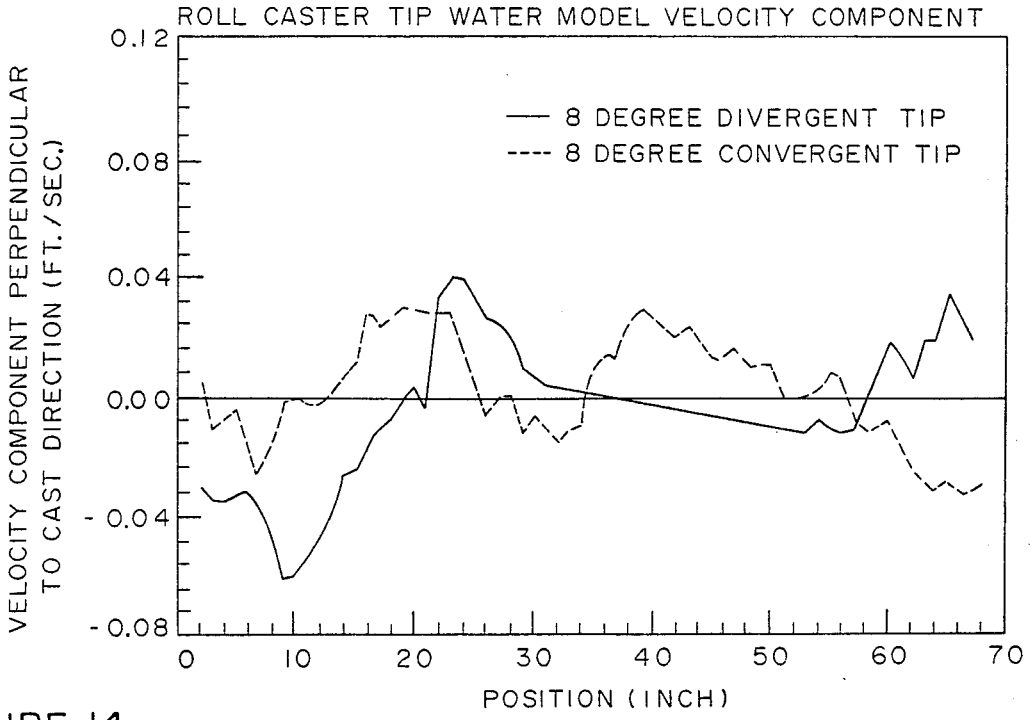
FIGURE 14 EQUIVALENT CASTING RATE 180 LBS./HR./INCH
READINGS 7.5 INCHES FROM TIP DISCHARGE
90 DEG. COUNTER CLOCKWISE TO CASTING DIRECTION IS POSITIVE

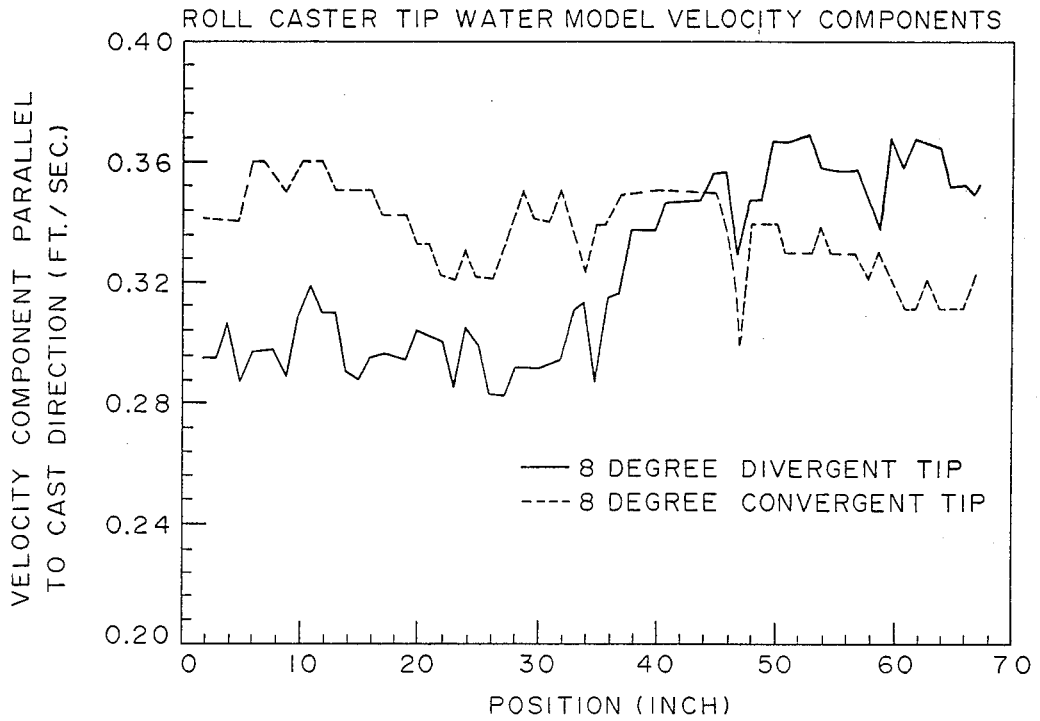
FIGURE 15 EQUIVALENT CASTING RATE 180 LBS./HR./INCH
READINGS 2.5 INCHES FROM TIP DISCHARGE
CASTING DIRECTION IS POSITIVE
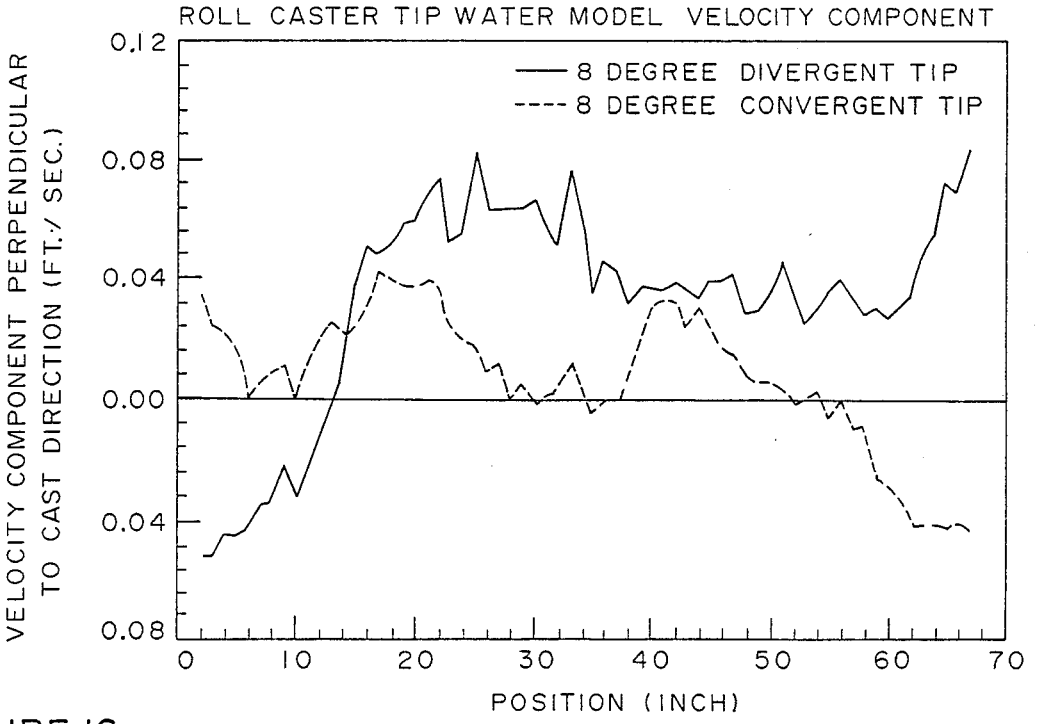
FIGURE 16 EQUIVALENT CASTING RATE 180 LBS./HR./INCH
READINGS 2.5 INCHES FROM TIP DISCHARGE
90 DEG. COUNTER CLOCKWISE TO CASTING DIRECTION IS POSITIVE

ROLL CASTER APPARATUS HAVING NOZZLE TIP ASSEMBLY WITH NOVEL SPACER MEMBER

BACKGROUND OF THE INVENTION

1. Technical Field of the Invention

This invention relates to roll casting of molten metal. More particularly, this invention relates to improvements in apparatus controlling the flow of molten metal from a reservoir to a rolling mechanism.

2. Background Art

The processing of molten metal by continuous casting to convert it to plate or sheet fabricatable into various shapes conventionally involves the delivery of molten metal to a pair of rollers from a casting nozzle comprising an elongated nozzle tip.

Process economics would justify the continuous casting and subsequent rolling of wide sheets, i.e., over 40 inches in width, as well as faster rolling speeds, i.e., 200 lb/in/hr. However, shortcomings in nozzle tip design resulting in nonuniform molten metal temperature and exit velocities of the molten metal entering the nip of the rollers have prevented use of such widths and speeds.

These problems in nozzle tip design, including nonuniform metal flow velocity profiles across the nozzle tip and nonuniform temperature distribution, as well as flow disturbances adjacent the side risers of the nozzle and any spacers which may be present within the nozzle, can result in hot spots in roll caster and consequently cause bleed out at high speed casting. Furthermore, flow disturbances and separation caused by the internal structures of the nozzle tip can cause surface defects on the resulting cast plate or sheet. The latter condition of flow disturbances is particularly complicated by the necessity of utilizing some sort of spacers to support the top wall of the nozzle and to maintain uniformity of spacing between the top wall and bottom wall of the nozzle when attempting to cast wide plate or sheet by continuous casting techniques.

In the prior art, regulation of metal flow has been attempted using divergent channels which may contain baffles. For example, Chateau et al U.S. Pat. No. 4,153,101 provide a nozzle having a lower plate and upper plate separated by cross pieces and side end portions which are divergent along at least a portion adjacent the end of the nozzle.

Blossey et al U.S. Pat. No. 3,799,410 show a feed tip having baffles therein which coact in controlling the direction of flow of molten metal through the cavity in such a manner said to insure continuous distribution of molten metal to the nozzle uniformly throughout its length.

However, the control of the metal flow velocity as well as uniform temperature distribution within the nozzle, particularly when a wide casting strip is desired, has been found to involve design criteria which are not satisfied by the prior art.

SUMMARY OF THE INVENTION

It is, therefore, an object of the invention to provide an improved roll casting apparatus which may be used to cast wide strips of metal continuously.

It is another object of the invention to provide an improved roll casting apparatus which may be used to cast wide strips of metal continuously by maintaining more uniform metal velocity throughout the width of the nozzle tip.

It is yet another object of the invention to provide an improved roll casting apparatus which may be used to cast wide strips of metal continuously while maintaining a uniform temperature distribution of said metal across the width of the nozzle tip.

It is a further object of the invention to provide an improved roll casting apparatus which may be used to cast wide strips of metal continuously wherein one or more spacers are positioned between the top wall and the bottom wall of the nozzle tip to maintain uniform spacing across the width of the nozzle tip.

It is yet a further object of the invention to provide an improved roll casting apparatus which may be used to cast wide strips of metal continuously wherein one or more spacers have a curved leading edge and a streamlined trailing edge are positioned between the top wall and the bottom wall of the nozzle tip to maintain uniform spacing across the width of the nozzle tip and to minimize interference with metal stream velocity.

These and other objects of the invention will become apparent from the following description and accompanying drawings.

In accordance with the invention, an improved roll caster tip apparatus is provided comprising a molten metal reservoir having a bottom plate and at least one sidewall and a tip member attached to the sidewall having a top wall, a bottom wall and a pair of side riser members between the top wall and the bottom wall to form a passageway with the top and bottom walls and at least one spacer member between the top wall and the bottom wall spaced from the side riser members to provide support for the top wall and bottom wall, the spacer member having a curved leading portion facing the reservoir and a streamlined trailing portion extending in the direction away from the reservoir whereby interference with metal flow velocity by flow separation caused by the spacer is minimized.

BRIEF DESCRIPTION OF THE DRAWINGS

FIGS. 9–16 are graphs which respectively show the metal velocity profiles parallel and perpendicular to the metal flow across a nozzle tip at two casting rates and at two measurement positions with respect to the nozzle exit port.

DESCRIPTION OF THE PREFERRED EMBODIMENT

Figure 1:
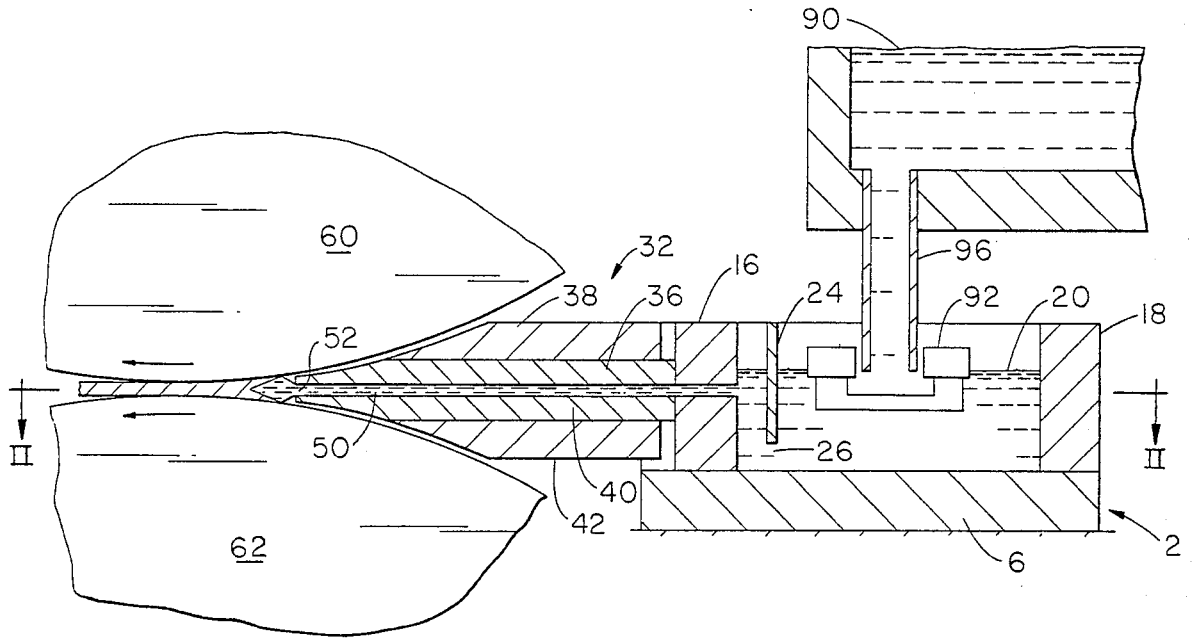
FIG. 1 is a side view in section of the apparatus of the invention.
Figure 2:
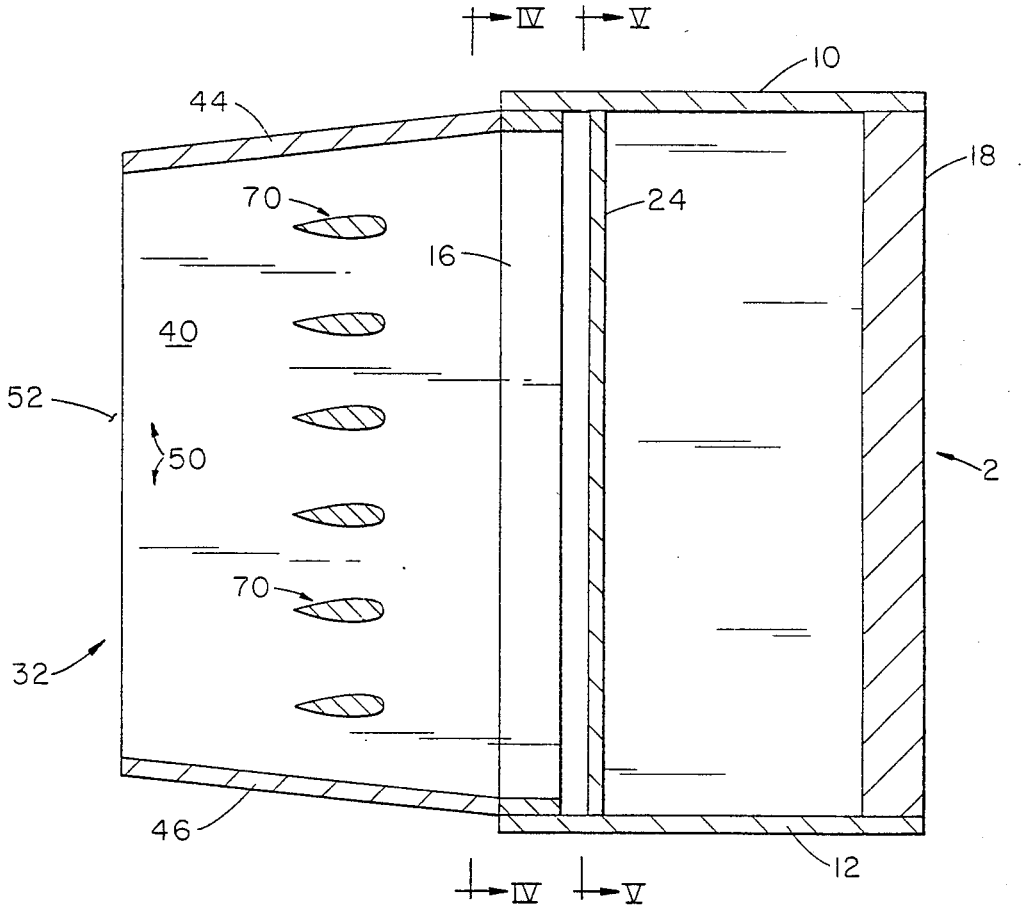
FIG. 2 is a top view in section of the apparatus of the invention.

Referring in particular to FIGS. 1 and 2, the apparatus of the invention includes a reservoir generally indicated at 2 and a tip member attached thereto and generally indicated at 32. Reservoir 2 comprises a bottom plate 6, a pair of end walls 10 and 12 and sidewalls 16 and 18. Mounted within reservoir 2 is a flow-restricting member 24 which forms an opening 26 to regulate the flow of molten metal 20 in reservoir 2 into tip member 32, as will be described in more detail below. The level of molten metal 20 in reservoir 2 is maintained by metal level control 92 through which molten metal flows via spout 96 from molten metal source 90. Metal level control 92 controls the flow rate of metal into reservoir 2 using a float to determine and control the level of molten metal in reservoir 2.

Tip member 32 serves to supply a flow of molten metal from reservoir 2 to the nip of a pair of rollers 60 and 62, as shown in FIG. 1. This flow of a ribbon of molten metal should be of uniform velocity and temperature distribution across the entire width of tip member 32 which may vary commercially from as little as 36 inches to as much as 60 inches or more. Maintaining such uniform metal flow and temperature characteristics for widths of 60 inches or more have been unattainable in the prior art.

Figure 4:
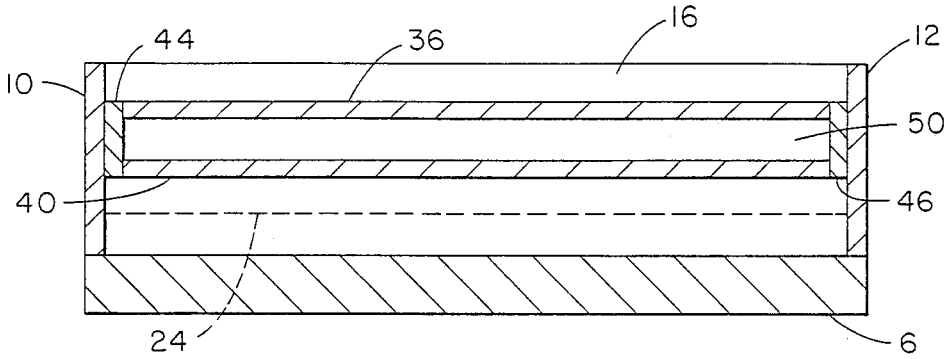
FIG. 4 is an end view in section of the apparatus shown in FIG. 2 taken along lines IV—IV.
Figure 5:
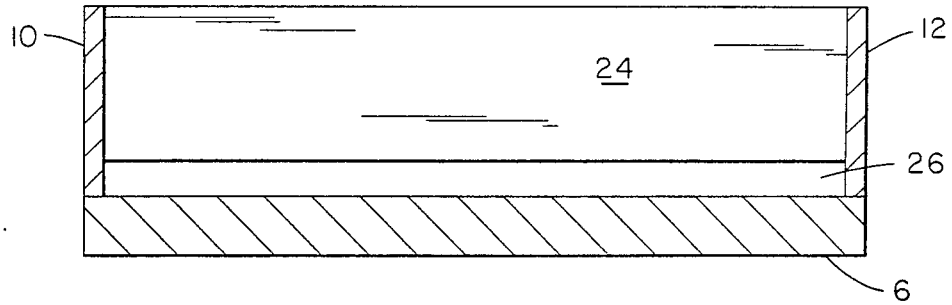
FIG. 5 is an end view in section of the apparatus shown in FIG. 2 taken along lines V—V.

Tip member 32 comprises a top wall 36 and a bottom wall 40 supported by tip clamp members 38 and 42. As shown in FIGS. 1, 2 and 4, top wall 36 and bottom wall 40 are joined together by side riser members 44 and 46 to define a passageway 50. Top wall 36, bottom wall 40 and side riser members 44 and 46 are all joined, at one end, to reservoir sidewall 16, as shown in FIG. 4. An opening in sidewall 16 conforms spatially to the passageway defined by the joining together of the wall members comprising tip member 32 at their juncture with sidewall 16.

As shown in FIG. 1, the facing surfaces of top wall 36 and bottom wall 40 are, preferably, essentially parallel from the ends joined to sidewall 16 to exit port 52 at the nip of rollers 60 and 62. Thus, in the preferred embodiment, internal passageway 50 within tip member 32 is of uniform height. However, top wall 36 and bottom wall 40 may converge slightly, i.e., up to about 5°, to insure that there is no divergence. When convergence of the top wall and bottom wall is used, reference herein to spacing between the top wall and the bottom wall will mean average spacing distance.

Side riser members 44 and 46, however, are positioned to be convergent at the exit port 52 of tip member 32. By making side riser members convergent, flow separation and reverse flow will be eliminated near the side riser member. The convergent channel formed thereby provides a favorable pressure gradient along the walls and an accelerating main flow which limits the boundary layer thickness growth of the flowing metal downstream. This eliminates, or at least reduces to a minimum, one cause of nonuniformity in the metal flow velocity found in the prior art.

As shown in FIG. 2, this convergence of the side riser members may be represented by straight (i.e., linear) riser members which are mounted to slant toward one another or converge. While the slanting or convergence of side risers 44 and 46 has been somewhat exaggerated in FIG. 2 for illustrative purposes, the convergence angle may be from 1° to 45°, preferably from 1° to 15°, and most preferably from 2° to 10°.

Figure 7:
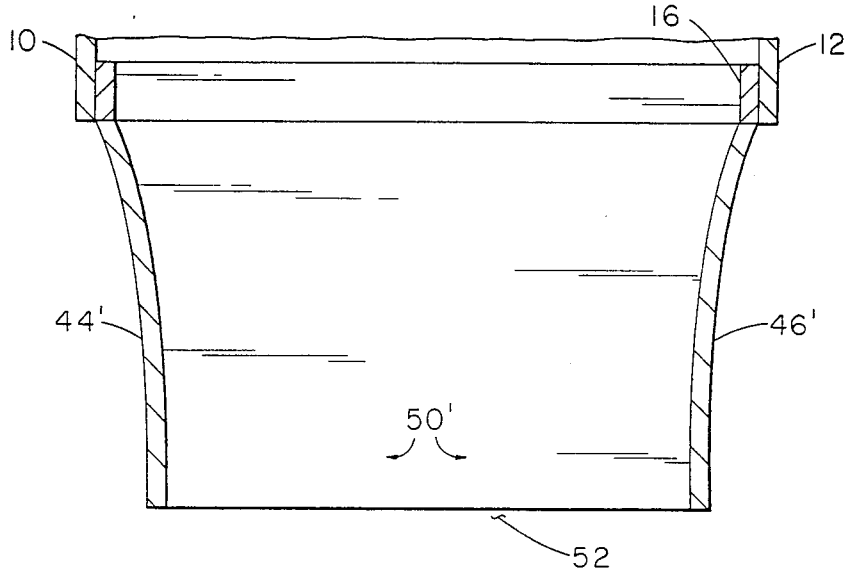
FIG. 7 is a top view in section of another embodiment of the invention.

Alternatively, the side riser members may be curved in either a convex or concave curvature. As shown in FIG. 7, side riser members 44' and 46' are convex as viewed from their inner, facing, surfaces, i.e., from passageway 50'. This provides a convergence which tapers off in rate as the exit port 52 is approached.

Figure 8:
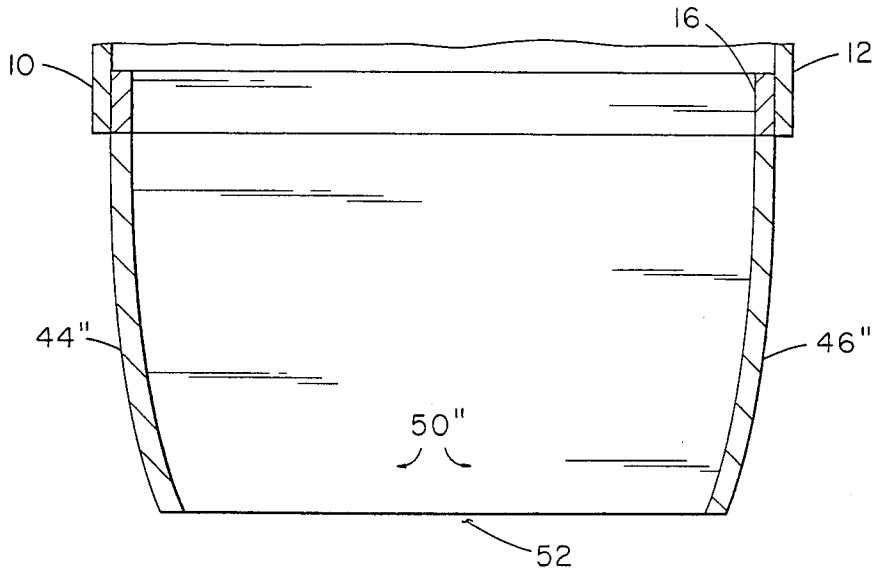
FIG. 8 is a top view in section of yet another embodiment of the invention.

In another embodiment, as shown in FIG. 8, side riser members 44" and 46" are concave as viewed from their inner, facing surfaces, i.e., from passageway 50". This provides a convergence having an increasing rate as exit port 52 is approached.

Figure 3:
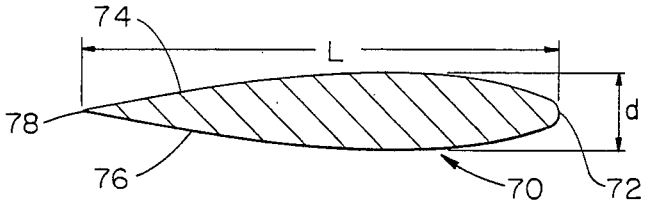
FIG. 3 is a top view in section of the spacer used in the apparatus of the invention.

As previously stated, one of the goals of the improved apparatus of the invention is to permit the casting of very wide sheet, i.e., 60" or more, while maintaining uniform metal flow and temperature conditions. To achieve this, the spacing between top wall 36 and bottom wall 40 must be uniformly maintained across the width of passageway 50. This necessitates the use of one or more spacers to maintain the desired uniform distance between top wall 36 and bottom wall 40 which may be as small as 0.194 inch at exit port 52. The use of a spacer is not new; however, prior art spacers were not necessarily designed or positioned to provide minimal interference with the desired uniform metal flow characteristics. In FIG. 3, a spacer 70 is illustrated which has been designed to minimize adverse effects on flow conditions. The leading edge 72 of spacer 70, which faces the flow of metal, is curved to permit the metal flow to smoothly pass on both sides. The trailing edges 74 and 76 of spacer 70 terminate in a point 78 to provide a streamlined shape to minimize disturbance to the main flow of metal and eliminate or minimize separation.

To achieve the desired streamline shape and flow characteristics, the width "d" of spacer 70, measured at its widest point as shown in FIG. 3, should not exceed 15% of the chord length "L" of spacer 70.

The presence of one or more spacers in the metal flow path can affect the flow profile. As shown in FIG. 2, the positioning of spacers 70 with respect to their distance from exit port 52 is also important since a wake profile is developed denoting the flow region behind a solid body, i.e., spacer 70, placed in the stream of molten metal. The velocities of the metal flow in the wake are smaller than those in the main stream, and the losses in the wake amount to a loss of momentum which is due to the drag on the spacer. The spread of the wake increases as the distance from the spacer increases and, therefore, the differences between the velocity in the wake and that outside the wake become smaller as the distance from the spacer increases.

To recover at least about 95% of the velocity of the main stream in the wake area, it is important to position spacer 70 a minimum distance from exit port 52. If spacer 70 is positioned from exit port 52 a distance at least one and one-half, preferably two, and most preferably three or more, times the length of the chord of spacer 70 along the larger dimension, e.g., length "L" in FIG. 3 extending from a point on the spacer closest to the reservoir to the terminus of the streamline portion of the spacer, the desired 95% recovery of velocity of metal flow will be achieved by the time the metal reaches exit port 52. Uniformity of metal velocity may then be achieved with minimal interference from spacers if they are used.

To achieve the desired uniform flow profile, it is preferable that the main stream flow have a Hele-Shaw profile, i.e., a reduced Reynolds number of less than 1. However, in practice, due to geometry constraints, it may not be possible to maintain the Reynolds number below unity. It has been observed in experiments that a flow having a reduced Reynolds number of 400 or less provides an acceptable uniformity of flow profile. Preferably, however, the reduced Reynolds number is less than 200, and most preferably the reduced Reynolds number is less than 1.

The criterion on which Hele-Shaw flow, or a nearly Hele-Shaw flow condition, takes place is given by the reduced Reynolds number, R*, in accordance with the following equation:

$$R^* = UL/\mu \times h^2/L^2$$

wherein:

R*=not greater than 400, preferably less than 200, and most preferably less than 1;

U=average velocity of metal entering the tip in cm/sec.;

L=the chord length of the spacer;

$\mu$=kinematic viscosity of molten aluminum (approximately $5.17\times10^{-3}$ cm$^2$/sec.); and h=$\frac{1}{2}$ the height between the top wall and the bottom wall.

The foregoing parameters insure the preservation of entry metal flow profiles within nozzle tip member 32 which will deliver a band of molten metal to rollers 60 and 62 having a uniform velocity and temperature distribution to inhibit sticking and heat transfer problems during initial rolling, if it is assumed that metal at a uniform velocity is delivered to nozzle tip member 32 from reservoir 2. However, if the metal flow into nozzle tip member 32 is non-uniform, it may be impossible to develop a uniform metal flow velocity downstream because of the Hele-Shaw flow conditions which preserve the velocity profile of the molten metal after its entry into the tip. In other words, if the entrance velocity is nonuniform, the Hele-Shaw flow conditions will preserve this nonuniformity as the metal flows through the tip. Thus, it is imperative that the entrance velocity of the molten metal be as uniform as possible.

To provide for a uniform flow of metal into nozzle tip member 32, a baffle 24 is placed in reservoir 2, as shown in FIGS. 1, 2, 4 and 5. Baffle 24, as shown in FIG. 4, extends across the entire width of nozzle tip member 32 from side riser member 44 to side riser member 46. Baffle 24 extends down from the top of reservoir 2 below the surface of the molten metal in the reservoir to a point just above bottom plate 6 of reservoir 2 to form a passageway 26 which extends across the entire width of reservoir 2. As reservoir 2 is replenished with molten metal from molten metal source 90, baffle 24 provides a shielding from any turbulence created in reservoir 2 by such additions and provides uniform friction across the entire width of nozzle 32. The feeding of a steady, uniform flow of molten metal into nozzle tip member 32 is thereby assured.

Figure 6:
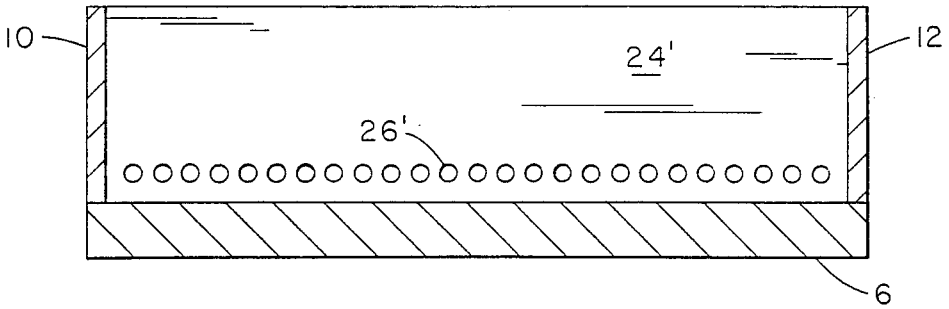
FIG. 6 is an end view in section of another embodiment of the view shown in FIG. 5.

FIG. 6 shows an alternate embodiment wherein baffle 24' is provided with a series of holes 26' across the bottom portion of baffle 24'. The function of holes 26', which are of uniform diameter, is to provide uniform friction across the entire width of nozzle tip 32 at its jointure to wall 16 of reservoir 2 to insure uniform entrance velocity of the molten metal into nozzle tip 32 in similar fashion to the function of opening 26 created by the position of baffle member 24.

FIGS. 9 through 16 illustrate typical metal velocity profiles which can be expected utilizing the teachings of the invention in a casting apparatus having a 68 inch wide tip and using respective casting rates of 80 lbs/hr/in and 180 lbs/hr/in. In each instance, a spacer having a $1\frac{1}{2}$ inch chord length was located 5 inches from the exit port of the nozzle tip (measured from the trailing edge of the spacer). This location of the spacer from the exit port was possible because the Hele-Shaw flow conditions insure quicker recovery of the flat velocity profile downstream of the spacers.

FIGS. 9, 10, 13 and 14 show measurements taken $7\frac{1}{2}$ inches from the exit port, i.e., before the metal flow encounters the leading edge of the spacer, while FIGS. 11, 12, 15 and 16 represent measurements taken $2\frac{1}{2}$ inches from the exit port, i.e., $2\frac{1}{2}$ inches beyond the trailing edge of the spacer. At both the $2\frac{1}{2}$ inch and $7\frac{1}{2}$ inch measurement points, the metal velocity was measured parallel to the metal flow and perpendicular to the metal flow, i.e., toward the side risers. Hele-Shaw flow conditions ensure quicker recovery of the flat velocity profile downstream of the spacers.

In each instance, a comparison measurement was also taken with a nozzle tip having divergent side risers. Plots of the metal flow velocities in the nozzle tips having divergent side risers are shown in solid lines, and the metal flow velocities in the nozzle tips of the invention having convergent side risers are shown by the dotted lines.

Thus, the invention provides an improved flow control of molten metal from a reservoir to a rolling mechanism for the direct roll casting of metal plate or sheet from molten metal. Uniform metal velocity and temperature control within the nozzle tip assures the minimization of problems with sticking of metal to the rollers as well as heat transfer problems which have characterized prior art approaches in the past.

Having thus described the invention, what is claimed is:

1. An improved roll caster tip apparatus having improved uniformity of metal flow velocity for casting wide strips of metal comprising:

(a) a reservoir for molten metal comprising a bottom plate and at least one sidewall; and (b) a tip member attached to said sidewall and terminating in an exit port spaced from said reservoir, said tip member comprising:

(i) a top wall and a bottom wall;

(ii) a pair of side riser members between said top wall and said bottom wall to form a passageway with said top and bottom walls; and (iii) at least one spacer member between said top wall and said bottom wall spaced from said side riser members to provide support for said top wall and bottom wall, said spacer member having a curved leading portion facing said reservoir and a streamlined trailing portion extending in the direction away from said reservoir whereby interference with metal flow velocity by flow separation caused by said spacer is minimized.

2. The assembly of claim 1 wherein said streamlined portion of said spacer terminates in a point.

3. The assembly of claim 1 wherein the maximum width of said spacer is not greater than 15% of the length of the chord extending from a point on said spacer closest to said reservoir to the terminus of said streamlined portion of said spacer.

4. The assembly of claim 1 wherein said spacer is proportionally shaped as shown in FIG. 3.

5. The assembly of claim 1 wherein said spacer is located in said tip member at a distance from said exit port at least two times the length of said spacer.

6. The assembly of claim 1 wherein said spacer is located in said tip member at a distance from said exit port three or more times the length of said spacer.

7. The assembly of claim 5 wherein said streamlined portion of said spacer terminates in a point and said spacing of said exit port from said spacer is measured from said point.

8. The assembly of claim 5 wherein the length of said spacer is measured as a chord extending from a point on said spacer closest to said reservoir to the terminus of said streamlined portion on said spacer.

9. An improved roll caster tip apparatus having improved uniformity of metal flow velocity for casting wide strips of metal comprising:

(a) a molten reservoir comprising a bottom plate and at least one sidewall; and (b) a tip member attached to said sidewall and terminating in an exit port spaced from said reservoir, said tip member comprising:

(i) a top wall and a bottom wall;

(ii) a pair of side riser members between said top wall and said bottom wall to form a passageway with said top and bottom walls; and (iii) at least one spacer member between said top wall and said bottom wall spaced from said side riser members to provide support for said top wall and bottom wall and located from said exit port a distance equal to at least twice the chord length of the spacer, said spacer member having a curved leading portion facing said reservoir, a streamlined trailing portion terminating in a point extending in the direction away from said reservoir and having a width not exceeding 15% of the chord length of said spacer:

whereby interference with metal flow velocity by flow separation caused by said spacer is minimized.

10. An improved roll caster tip apparatus having improved uniformity of metal flow velocity for casting wide strips of metal comprising:

(a) a reservoir for molten metal comprising a bottom plate and at least one sidewall; and (b) a tip member attached to said sidewall and terminating in an exit port spaced from said reservoir, said tip member comprising:

(i) a top wall and a bottom wall;

(ii) a pair of side risers members between said top wall and said bottom wall to form a passageway with said top and bottom walls; and (iii) at least one spacer member between said top wall and said bottom wall spaced from said side riser members to provide support for said top wall and bottom wall, said spacer member having a curved leading edge (72) facing said reservoir to permit the metal flow to smoothly pass on both sides and streamlined trailing edges (74) and (76) which terminate in a point (78) in the direction away from said reservoir to provide a streamlined shape to minimize disturbance to the main flow of metal and minimize or eliminate separation.

* * * * *